United States Patent [19]

Randisi

[11] Patent Number: 5,037,566

[45] Date of Patent: Aug. 6, 1991

[54] LUBRICATING COMPOSITION AND METHOD FOR MAKING SAME

[76] Inventor: Salvatore A. Randisi, 129 Autumn Dr., Hauppauge, N.Y. 11788

[21] Appl. No.: 464,564

[22] Filed: Jan. 16, 1990

Related U.S. Application Data

[63] Continuation-in-part of Ser. No. 363,329, Jun. 8, 1989, abandoned, which is a continuation of Ser. No. 88,996, Aug. 21, 1987, abandoned, which is a continuation of Ser. No. 872,221, Jun. 9, 1986, abandoned.

[51] Int. Cl.[5] ..... C10M 141/04

[52] U.S. Cl. ..... 252/28; 252/30; 252/32.5; 252/52 R

[58] Field of Search ..... 252/28, 30, 32.5, 52 R

[56] References Cited

U.S. PATENT DOCUMENTS

| | | | |
|---|---|---|---|
| 3,453,210 | 7/1969 | Wright | 252/28 |
| 3,639,237 | 2/1972 | Curtis | 252/28 |
| 3,770,633 | 11/1973 | Holley et al. | 252/28 |
| 3,793,197 | 2/1974 | Chapman | 252/28 |
| 4,062,784 | 12/1977 | Baur | 252/49.5 |
| 4,075,113 | 2/1978 | Van Doorne | 252/35 |
| 4,337,161 | 6/1982 | Stayner | 252/49.5 |
| 4,396,514 | 8/1983 | Randisi | 252/28 |
| 4,514,312 | 4/1985 | Ront et al. | 252/32.5 |

*Primary Examiner*—Jacqueline V. Howard
*Attorney, Agent, or Firm*—Stephen E. Feldman

[57] ABSTRACT

A lubricating composition is provided which is a stable dispersion of a synthetic oil, such as polyalphaolefin oil; finely divided polymeric fluorocarbon powder, such as polytetrafluoroethylene (e.g., Teflon); a silicon dioxide powder which is substantially 100% hydrophobic; a glycol, such as polypropylene glycol; a substance to increase viscosity, such as polybutene; and an agent to withstand extreme compression loads, such as an amine phosphate. The lubricating composition is made where ingredients are added in a particular sequence and where they are subjected to the shearing action at the elevated temperatures and under vacuum.

The lubricating composition provides high corrosion resistance due to the absence of dissolved air and moisture. It also has an excellent lubricity, extremely low moisture absorbancy, a very low oxidation rate and an outstanding performance under extreme compression conditions.

15 Claims, 1 Drawing Sheet

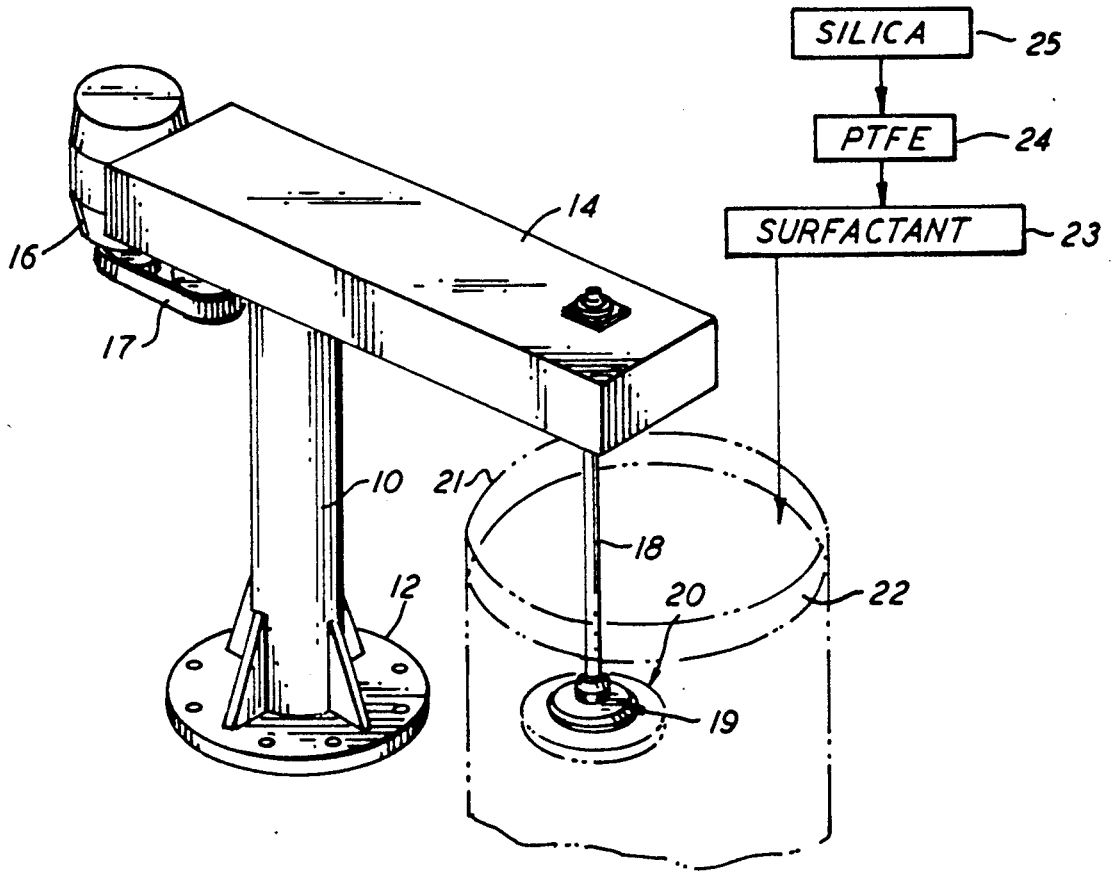
SILICA
25
PTFE
24
SURFACTANT
23
14
16
17
10
21
18
12
20
22
19

LUBRICATING COMPOSITION AND METHOD FOR MAKING SAME

This application is a continuation-in-part of application Ser. No. 07/363,329, filed Jun. 8, 1989 which is a continuation of 07/088,996, filed Aug. 21, 1987 which is a continuation of 06/872,221 filed Jun. 9, 1986, all now abandoned.

FIELD OF THE INVENTION

This invention relates to a lubricating composition.

More specifically, this invention relates to an improved, highly anti-corrosive lubricating composition having practically no air or moisture.

BACKGROUND AND DISCUSSION OF THE PRIOR ART

It was known in the prior art to combine various oils and greases with powders of polymeric fluorocarbons in order to generally increase the lubricating quality and durability of the lubricant. However, present improved lubricating composition and method are not known. U.S. Pat. No. 3,664,956 granted May 3, 1972 to Messina, et al, discloses a lubricant comprising polytetrafluoroethylene in combination with polysiloxanes and a grease composition.

Typically, these oil and grease based lubricants contained other additives in addition to polymeric fluorocarbons so as to create or improve a characteristic of the lubricating composition.

For instance, U.S. Pat. No. 4,224,173 granted Sept. 23, 1980 to Reick, discloses the use of a lubricating oil containing polytetrafluoroethylene (PTFE) particles and a fluorochemical surfactant for stabilizing the oil-PTFE dispersion and reducing volatilization losses during use of the lubricant in an internal combustion engine.

In U.S. Pat. No. 3,723,317 granted Mar. 27, 1973 to Ulery, lubricating greases are disclosed which comprise a fluorinated polyester, a base oil, PTFE and a triazine compound for improving anti-corrosive and air oxidation resistance qualities of the lubricant.

The prior art of U.S. Pat. No. 3,933,656 granted Jan. 20, 1976 to Rick, also discloses a lubricant comprising a base oil intermixed with a dispersion of PTFE particles and a silane which, acting as a charge neutralizing compound, prevents a clumping together of the PTFE particles in suspension.

In order to enable the lubricant dispersions to retain their structural integrity and stability under extreme pressure and temperature and sheer stress conditions and to prevent the settling out of suspended particles such as PTFE, the prior art typically added thickeners such as fatty acid soaps, metal salts, mineral diatoms and organic polymers. U.S. Pat. No. 3,493,513 granted Feb. 3, 1970 to Petriello, discloses a lubricating grease and oil composition comprising a base oil PTFE particles and a selected amount of polyethylene added as a thickener. U.S. Pat. No. 3,639,237 granted Feb. 1, 1971 to Curtis also relates to a lubricant grease which comprises a base oil, PTFE powder, and further comprises colloidal asbestos and other inorganic thickeners selected from talc, graphite and Group I, II and IV metal oxides and carbonates.

However, the grease compositions embodying these thickening agents typically fail in prolonged or excessive service of storage. Further, the metal salts in bearing systems used in the prior art can be corrosive to the metallurgical entities and can cause stress cracking in plastic bearings. In addition, the mineral diatoms are frequently hygroscopic and can induce hydrolytic breakdown of the oil base and undergo bleed-out, a phenomena whereby the physical saturation or absorption changes under bearing stress. Polyethylene, while substantially resistant to hydrolytic reaction, undergoes slow but relentless oxidation and crystallization under frictional wear and stress. In addition, grease containing asbestos fibers may be abrasive. Many of the thickeners used may also increase the toxicity of the lubricant within which it is used, thereby restricting its possible commercial applications.

Furthermore, many current grease-type lubricants are generally inoperable over a wide temperature range, especially at extreme low temperatures, and are thus not completely suitable for many potential commercial or military applications. For example, where lubricants do not possess physical characteristics which will permit their successful and reliable operation in equipment at extremely low temperatures, serious operational problems are introduced which often necessitates the use of auxiliary heaters to raise ambient temperatures.

Another problem with many present lubricants is their corrosiveness and stability to oxidation. It is known that if the lubricant contains dissolved air or moisture, its corrosiveness greatly increases. If such corrosive lubricants are used, the life of the part containing them is significantly shortened. The stability of the lubricant to oxidation is also extremely important: if such stability is low, the useful properties of the lubricant will be negatively affected. Randisi, U.S. Pat. No. 4,396,516 describes an improved lubricating composition and method for making it. However, the present invention provides for the composition with the different ingredients and method, allowing to make the composition with the oxidation resistance of about 50% higher than that of the composition of the U.S. Pat. No. 4,396,516, compression load and shear load capabilities of about 10% higher than that of the composition of said patent, and other valuable properties which will be seen from the description and claims below.

It is an additional object of this invention to provide a lubricant with a low toxicity and significantly extended shelf life.

It is still another object of this invention to provide a lubricating composition which would be able to withstand extreme compression of contacting moving parts.

The aforesaid as well as, other objects and advantages will be made more apparent in reading the following description and the adjoined claims.

BRIEF DESCRIPTION OF THE DRAWINGS

FIG. 1 is a schematic drawing of the installation for making the lubricating composition of the present invention.

SUMMARY OF THE INVENTION

It has been found, in accordance with this invention that by incorporating in a lubricating fluid, such as a synthetic hydrocarbon, the combination of 1) a silicon dioxide in the form of 100% hydrophobic fumed silica dioxide; 2) amine phosphate; 3) a polybutene; and 4) glycol—an improved lubricant results.

It has also been found that by using a vacuum in the preparation of a lubricating composition, it is possible to obtain a composition with extremely low corrosiveness, and extremely low content of air and moisture, resulting in greatly improved lubricating properties.

DESCRIPTION OF THE PREFERRED EMBODIMENTS

Broadly speaking, the lubricating composition of the present invention comprises a stable dispersion of a synthetic lubricating fluid, a polymeric fluorocarbon, substantially 100% hydrophobic silicon dioxide, amine phosphate, polybutene and glycol, preferably polypropylene glycol. This lubricating composition may be used in any system which now uses ordinary lubricants.

The synthetic lubricating fluids preferred for use in this invention are low molecular weight saturated polyalphaolefins and hydrogenated oligomers of short chain normal alphaolefins. These synthetic hydrocarbon lubricating fluids are readily available commercial commodities. They are marketed by Uniroyal under the trade name "Uniroyal PAO" and by Gulf Petrochemicals under the trade name "Synfluid." Both fluids are available in different grades or weights. It is preferred for this invention to use a blend of about 6 and 40 weight oil.

The use of these synthetic fluids insures a highly pure lubricating fluid which also helps to conserve shrinking world supplies of natural petroleum reserves.

The synthetic hydrocarbon lubricating fluid makes up the balance of the composition and will usually be present in an amount in the range of 50 to 90 percent.

Any polymeric fluorocarbon powder can be used in this invention, provided it is characterized by a high melting point, i.e., above 450° F., and consists of finely divided particles whose average size range from submicron (e.g., about 0.1 micron) to 100-micron size. Preferably, these particles will have an average particle size of about 0.7 microns. Preferred are the polymeric fluorocarbons selected from the group consisting of polytetrafluoroethylene (TFE) and fluorinated ethylene propylene (FEP) copolymer. The polymeric fluorocarbon compounds operable in this invention may be purchased as readily available commercial commodities under such trade names as "TFE Teflon" and "FEP Teflon." The polytetrafluoroethylene is a polymer of a fully fluorinated hydrocarbon of the basic chemical formula ($—CF_2—CF_2—$) containing 71 percent by weight of fluorinated ethylene. The propylene copolymer is a fully fluorinated resin prepared by polymerization of tetrafluorethylene and hexafluoropropylene to form a copolmer containing about 5 to about 50 weight percent hexafluoropropylene and about 95 to about 50 weight percent tetrafluoroethylene. These copolymers have respective melting points ranging from about 480° F. to about 560° F. Especially preferred for use in this invention is polytetrafluoroethylene (PTFE).

It is preferable that the polymeric fluorocarbon comprise from about 1% to abot 5% of the lubricating composition. It is also contemplated that higher percentages may be used in the practice of the invention.

The substantially 100% hydrophobic silicon dioxide or fumed silica of the disclosed invention is produced from silicon tetrachloride in a flame hydrolysis process with oxygen-hydrogen gas. This process produces highly dispersed silicon dioxide of amorphous structure and great purity with controlled particle size. The finely divided fumed silica powder has particles which may range from about 7 to 40 millimicrons in size. It has also surprisingly been found that silicon dioxide particulates of such small size do not have abrasive characteristics. The preferred size particle for this invention rnages from 12–16 millimicron. Particles of various sizes may be intermixed in the lubricating composition or may all be of approximately the same size. The fumed silica powder is a readily available commercial product of the Degussa Corporation and is marketed under the trade name "Aerosil."

The use of the 100% hydrophobic silicon dioxide results in a lubricating composition with virtually no moisture and high resistance to moisture absorption. This in turn results in a non-corrosive lubricant, with greatly improved lubricating qualities, which does not promote rusting of the parts it is applied to.

The extreme thixotropic filler action of the fumed silica powder is a function of the silanol groups present on the surface of the particles in optimal density and their propensity to form hydrogen bonds. This characteristic may, in large part, account for the greater stability of the dispersion comprising the lubricating composition and thereby prevent the settling out or separating the polymeric fluorocarbon powder from the lubricating fluid. Furthermore, the electrical conductivity of the fumed silica is very poor and qualifies it in effect as an insulator. Even under adverse conditions (i.e., an exceptionally high moisture content), the electrical resistivity of the fumed silica is still about $10\times10^{12}$ ohm/cm at packed densities of 50–60 g/l. This property greatly contributes to the high electrical resistance of this lubricating composition. It is preferred that the silicon dioxide or fumed silica particles comprise from about 2% to about 12% of the lubricating composition.

In many cases the lubricating composition is applied to gears or chain/sprocket mechanisms. The places where two gears interact, or where the chain interacts with the spocket, are points of extreme compression, when these systems are i motion. If a substance is applied at these places, it will be eventually "squeezed out" as the result of compression. It was found that if the lubricating composition has the amine phosphate as one of its components, it helps such composition withstand the extreme compression, and stay in place.

It was also found that phosphates give the lubricating composition other valuable properties. It renders the lubricating composition oxidation-resistant and decreases wear of parts it is applied to. The amine phosphates have a nitrogen content of from about 2% to about 3% by weight and phosphorus content of from about 3.5% to about 5.5% by weight.

The amine phosphates are readily available on the market under the name "Irgalube," and are produced by the CIBA-GEIGY Corp. The Irgalube 349 was found to be particularly useful. The typical physical properties of said amine phosphate are as follows:

Refractive index of 146, nitrogen content of about 2.7% by weight, phosphorus content of about 4.9% by weight, specific gravity of about 0.91 and viscosity of about 8750 centistokes at 25° C.

The polybutene gives the lubricating composition of present invention very valuable qualities.. It was found that if the polybutene is added to the lubricating composition, the composition becomes more tenacious and viscous, resulting in significantly improved lubricating qualities: it does not drip and stays where it was applied. It was also found that polybutene, when added to the lubricating composition, gives the composition rust-inhibiting qualities. This is a very important and desirable quality of the lubricating composition because it significantly prolongs the life of the part employing it.

Polybutenes are marketed by Chevron and are readily available. The Chevron's polybutenes have a mean molecular weight ranging between about 1,000 to about 2,000.

The following example is illustrative of the present invention:

EXAMPLE 1

The lubricating composition consists of the following ingredients:

Synton PAO 100 (Polyalphaolefin oil) 84%
PTFE Teflon 3%
Irgalube 349 1%
Chevron's Polybutene 32 1%
Polypropylene Glycol 1%
Aerosil R-972 ($SiO_2$) 10%

The tests were conducted with the above composition to test its performance under extreme pressure and its resistance to the oxidation.

The results of the Extreme Pressure Test using Timken Tester, or ASTM-D-2509 Load Test, for above composition are shown below at Table I:

TABLE I

| THE TEST'S NUMBER | TYPE OF LOAD | LBS. | KG. |
|---|---|---|---|
| 1st Test | OK Load | 75 lbs = | 32 kg |
| | Critical OK Load | 77 lbs = | 35 kg |
| | Failure Load | 80 lbs = | 38 kg |
| 2nd Test | OK Load | 81 lbs = | 38.5 kg |
| | Critical OK Load | 86 lbs = | 39.5 kg |
| | Failure Load | 96 lbs = | 44 kg |
| 3rd Load | OK Load | 79 lbs = | 36.5 kg |
| | Critical OK Load | 84.5 lbs = | 38.7 kg |
| | Failure Load | 94 lbs = | 42 kg |
| 4th Test | OK Load | 80 lbs = | 38 kg |
| | Critical OK Load | 85 lbs = | 39 kg |
| | Failure Load | 95 lbs = | 43.5 kg |
| Average E.P. | OK Load | 78.75 = | 35.7 kg |
| ASTM-D-2509 | Critical OK Load | 83.1 = | 37.7 kg |
| | Failure Load | 91.2 = | 41.4 kg |

(OK Load = Test block straight line scar no metal pickup
Critical OK Load = Test block straight line scar slight acceptable metal pickup.
Failure Load = Test block scar with excessive metal pickup and scar irregular.)

The oxidation resistance of the composition of the Example 1 was tested using the ASTM Oxygen Bomb method as described below:

| | |
|---|---|
| Test: | Composition Oxidation |
| Test Method: | Oxygen Bomb - ASTM |
| ASTM Method: | ASTM-D-942 |

Samples of the composition are placed in an oxygen bomb (Norma Hoffman type) and heated in an oil bath to 210° ± 1F and filled with oxygen to 110 PSI. Pressure is oserved after 100 hours.
Determination of 5 dish samples each containing 4 grams of the composition after the 100 hour period.
Less than 5 lb PSI drop was observed.
Typical results for a test are:

| | |
|---|---|
| 0–5 lb PSI drop | excellent |
| 5–10 lb PSI drop | good |
| 10–15 lb PSI drop | fair |
| Over 15 lb PSI drop | poor |

These tests show superb properties of the lubricating composition of Example 1 under extreme pressure, and its superb resistance to the oxidation.

While the aforesaid composition may be formed by blending techniques well-known in the art, it has been found that utilization of a specific method described below of making it produces a highly superior, completely homogenous and substantially air and moisture-free product.

FIG. 1 shows an installation for making the lubricating composition of the present invention.

Referring to FIG. 1, the representative dispersing apparatus of the invention includes pedestal 10 having a base 12 which rests on the floor or other supporting surface, and a bridge 14 supported on the upper end of the pedestal 10 with a motor 16 mounted on one end of the pedestal 10 with a motor 16 mounted on one end of the pedestal and an impeller shaft 18. Suitable belts and other drive means 17 extend from the motor through the bridge in a known manner to rotate the impeller.

Mounted on the lower end of the impeller shaft 18 is an impeller hub assembly 19 and disc 20 which may have a generally flat circular configuration with flanged teeth. The liquid to be mixed 22 is placed in the vessel 23 with cover 21 having opening 25, which allows cover 21 to slide up and down shaft 18. Cover 21 also has vent 24 which can be attached to a source of a vacuum. Therefore, when cover 21 is lowered, it hermetically seals vessel 23, and the mixing and dispersing can be done under the vacuum.

To prepare the lubricating composition of the present invention, all liquid components are placed in the reaction vessel 23. Such liquid components comprise polyalphaolefin, amine phosphate, polybutene and polypropylene glycol, and polyalphaolefin comprise from about 50% to about 95% of said lubricating composition; polybutene comprises from about 0.75% to about 1.25% of said lubricating composition. These liquid ingredients are blended together, and then the temperature is evaluated until it reaches a range from about 165° F., to about 180° F. After the temperature reaches the above range, a finely divided polymeric fluorocarbon powder comprising polytetrafluoroethylene with the particles ranging from about 0.1 to about 100 microns in size and having a melting temperature above 450° F. is added to the system in an amount from about 1% to about 5% of said lubricating composition. After that, the obtained system is sheared using a shearing means, until a substantially uniform dispersion of fluorocarbon powder is obtained. In one of the embodiments of the present invention, the disc-type, high speed impeller such as is disclosed in U.S. Pat. No. 4,171,166 granted Oct. 16, 1979 to Trowbridge et al, is used. The disclosure in that patent is incorporated herein by reference.

It has been found that stainless steel discs and not plastic discs, but are particularly effective to mix systems comprising viscous liquids and an particulate matter.

After substantially uniform dispersion of the fluorocarbon powder is obtained, a 100% hydrophobic silicon dioxide powder is added to the system while the system is uner high shear. The preferred silicon dioxide powder consists of particles ranging from about 7 to about 40 millimicrons in size, and comprises from about 2 to about 12% of the lubricating composition. After the silicon dioxide powder is added, the temperature of the system is elevated to the range of about 265° F., to 285° F., and this while maintaining the temperature at this range, the system is placed under a vacuum, where it is continued to be subjected to the shearing action until a homogenous, buttery substance is obtained. Preferably said vacuum is from about 25 to 30 inches high, and the system is subjected to the shearing action for about two hours to achieve said homogenous, buttery state.

As it was found, the use of the above procedure produces a composition which is practically free of air and moisture. The lubricating composition of the present invention is exhibits a unique combination of qualities invaluable for lubricants. It has excellent ability to withstand extreme compression at the points of contact between two moving parts. It exhibits an outstanding lubricating quality because of practically complete absence of air. This is due to the fact that instead of "riding" on a bed of air, the part is "riding" on a bed of the lubricant. Because of the absence of air and moisture, the lubricating composition of the present invention is noncorrosive. This results in the substantially prolonged life of parts to which the lubricating composition is applied. It also results in greatly extended life of the lubricating composition itself. The lubricating composition also has extremely low moisture absorbence.

The present invention has been described in detail above for purposes of illustration only and is not intended to be limited by this description or otherwise to exclude any variation or equivalent arrangement that would be apparent from, or reasonably suggested by, the foregoing disclosure to the skilled in the art.

We claim:

1. A method for making a substantially non-corrosive lubricating composition with improved resistance to oxidation, said composition being substantially free of air and moisture, where said composition can perform well under the conditions of extreme pressure, comprising:

a) providing a synthetic hydrocarbon lubricating liquid, said liquid comprising from about 50% to about 90% of said lubricating composition;

b) providing an amine phosphate, said amine phosphate comprising from about 0.75% to about 1.25% of said lubricating composition;

c) providing a polybutene, said polybutene comprising from about 0.75% to about 1.25% of said lubricating composition;

d) providing a polypropylene glycol, said polypropylene glycol comprising from about 0.75% to 1.25% of said lubricating composition;

e) blending all ingredients of steps "a" through "d" and elevating the temperature to from about 165° F. to about 180° F., or higher;

f) adding to the liquid obtained in step "e" a finely divided polymeric fluorocarbon powder comprising polytetrafluorethylene as a powder with particles ranging from about 0.1 to about 100 microns in size and having a melting temperature above 450° F., said polymeric fluorocarbon powder comprising from 1% to about 5% of said lubricating composition;

g) subjecting the mixture obtained in step "f" to the shearing action, using shearing means until a substantially uniform dispersion of said fluorocarbon powder is obtained;

h) adding to the mixture obtained in step "g" while said mixture is under shearing, a substantially 100% hydrophobic silicon dioxide in the form of finely divided fumed silica powder with particles ranging from about 7 to about 40 millimicrons in size, where said silicon dioxide comprises from about 2% to about 12% of said lubricating composition, and elevating the temperature of the resulting mixture to from about 265° F. to about 285° F., until striated structure disappears and it becomes of consistancy of heavy cream; and i) while maintaining the temperature from about 265° F. to about 285° F., and continuing to subject the mixture of step "h" to the shearing action, placing the mixture under vacuum and continuing to shear, until a homogenous buttery lubricating composition is obtained.

2. A method of claim 1 wherein said synthetic hydrocarbon lubricating liquid is polyalphaolefin oil.

3. A method of claim 2 wherein said amine phosphate has refractive index of 1.46, nitrogen content of about 2.7% by weight, phosphorus content of about 4.9% by weight, specific gravity of about 0.91, and viscosity of about 8750 centistokes at 25° C.

4. A method of claim 3 wherein said polyalphaolefin oil has viscosity of 100 centistokes at 100° C., and comprises about 84% of said lubricating composition; said polytetrafluoroethylene powder comprises about 3% of said lubricating composition; said amine phosphate comprises about 1% of said lubricating composition; said polybutene comprises about 1% of said lubricating composition; said silicon dioxide comprises about 10% of said lubricating composition; and said polyethylene glycol comprises about 1% of said lubricating composition.

5. A method of claim 3 wherein said vacuum is maintained from about 25 to 30 inches; said mixture is subjected to a shearing action for about two hours; and said elevated temperature in step "h" is maintained for about 30 minutes before said mixture is placed under the vacuum.

6. A method of claim 1 wherein said shearing means comprise a rotating disc impeller.

7. A method of claim 6, wherein said disc impeller is rotating at the speed of 1,600 rpm.

8. A method of claim 4, wherein said shearing means comprise a rotating disc impeller.

9. A method of claim 8, wherein said disc impeller is rotating at the speed of 1,600 rpm.

10. A method for the preparation of a lubricating composition for use with fiber optic elements which comprises:

a. mixing a base fluid with fluid additives by shearing in a mixer having a high speed impeller to achieve a homogenized and uniformly distributed mixture;

b. subjecting said mixture of a heat treatment at a temperature about 200° to 400° F. while continuing to shear the mixture to degas said mixture; and c. admixing the thus heat-treated mixture with a gelling agent in an amount of about 1 to about 10 parts by weight under a substantially high shear force sufficient to produce a homogeneous mixture.

11. A method for the preparation of a lubricating composition for use with fiber optic elements which comprises:

a. mixing a base fluid with fluid additives in a high shear mixer to homogenize and uniformly distribute the mixture;

b. while continuing to shear said mixture, heating to a temperature in the range of 200° to 400° F. to degas said mixture;

c. admixing the thus degassed mixture with a gelling agent in an amount of about 1 to about 10 parts by weight under a high shear force sufficient to produce a homogeneous mixture; and d. degassing said mixture in a vacuum of about 20 to about 30 inches of mercury.

12. A method as recited in claim 10 wherein said base fluid is butylene having the formula:

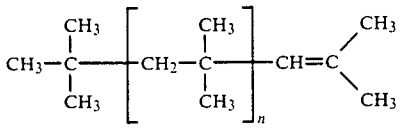

where n is from about 2 to about 40, said polybutene comprising from about 90% to about 99% by weight of said composition.

13. A method as recited in claim 10 wherein said additive is an oily polybutene having the formula:

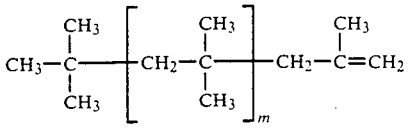

wherein m is from about 15 to about 35.

14. A method as recited in claim 10 wherein said additive is an amine phosphate.

15. A method as recited in claim 10 wherein said gelling agent is a hydrophobic fumed silica.

* * * * *